US008262817B2

(12) United States Patent
Marshall et al.

(10) Patent No.: US 8,262,817 B2
(45) Date of Patent: Sep. 11, 2012

(54) FIRST STAGE DUAL-ALLOY TURBINE WHEEL

(75) Inventors: Scott J. Marshall, Phoenix, AZ (US); Victor M. Reyes, Chandler, AZ (US); Timothy R. O'Brien, Chandler, AZ (US); Huy Tran, Litchfield Park, AZ (US); Andrew F. Szuromi, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 1461 days.

(21) Appl. No.: 11/761,209

(22) Filed: Jun. 11, 2007

(65) Prior Publication Data

US 2008/0304974 A1 Dec. 11, 2008

(51) Int. Cl.
*B22F 7/08* (2006.01)
*C22F 1/10* (2006.01)

(52) U.S. Cl. ..... 148/527; 148/555; 148/675; 419/8; 419/29; 419/49

(58) Field of Classification Search ..... 148/527, 148/537, 555, 675; 419/8, 29, 49
See application file for complete search history.

(56) References Cited

U.S. PATENT DOCUMENTS

| | | | | |
|---|---|---|---|---|
| 4,335,997 | A | 6/1982 | Ewing et al. | |
| 4,581,300 | A | 4/1986 | Hoppin, III et al. | |
| 4,659,288 | A * | 4/1987 | Clark et al. | 416/186 R |
| 4,787,821 | A | 11/1988 | Cruse et al. | |
| 4,907,947 | A * | 3/1990 | Hoppin, III | 416/241 R |
| 5,061,154 | A | 10/1991 | Kington | |
| 5,507,623 | A | 4/1996 | Kojima et al. | |
| 6,610,419 | B1 | 8/2003 | Stamm | |
| 6,756,131 | B2 | 6/2004 | Oguma et al. | |
| 6,969,240 | B2 | 11/2005 | Strangman | |
| 2005/0284150 | A1 | 12/2005 | Dittmar et al. | |
| 2006/0034695 | A1 | 2/2006 | Hall et al. | |
| 2003/0239825 | | 10/2006 | Rice et al. | |
| 2006/0222776 | A1 * | 10/2006 | Madhava et al. | 427/446 |
| 2008/0304972 | A1 * | 12/2008 | Xiao | 416/203 |

* cited by examiner

*Primary Examiner* — George Wyszomierski
*Assistant Examiner* — Mark L Shevin
(74) *Attorney, Agent, or Firm* — Ingrasia Fisher & Lorenz, P.C.

(57) ABSTRACT

A first-stage turbine that is adapted for receiving high energy air directly from a combustion chamber in a gas turbine engine auxiliary power unit includes a disk formed from a first alloy and having an outer surface, and a unitary blade wheel formed from a second alloy that is different than the first alloy. The unitary blade wheel includes an annular member having an inner surface that is joined to the disk, and blades that are integrally formed with the annular member.

15 Claims, 4 Drawing Sheets

FIRST STAGE DUAL-ALLOY TURBINE WHEEL

FIELD OF THE INVENTION

The present invention relates to all gas turbine engines. More particularly, the present invention relates to the architecture and materials for turbine wheels employed in auxiliary power units and main propulsion engines.

BACKGROUND OF THE INVENTION

Aircraft main engines not only provide propulsion for the aircraft, but in many instances are used to drive various other rotating components such as, for example, generators, compressors, and pumps, to thereby supply electrical, pneumatic, and/or hydraulic power. However, when an aircraft is on the ground, its main engines may not be operating. Moreover, in some instances the main engines may not be capable of supplying power. Thus, many aircraft include one or more auxiliary power units (APUs) to supplement the main propulsion engines in providing electrical and/or pneumatic power. An APU may additionally be used to start the main propulsion engines.

An APU is, in most instances, a gas turbine engine that includes a combustor, at least one power turbine, and a compressor. During operation of the APU, the compressor draws in ambient air, compresses it, and supplies compressed air to the combustor. The combustor receives fuel from a fuel source and the compressed air from the compressor, and supplies high energy compressed air to the power turbine, causing it to rotate.

Many APUs include multi-stage turbines with each generating work to drive other components such as a generator and a compressor impeller. The first-stage turbine is the first to receive high energy compressed air from the combustor, and is consequently subjected to temperatures of up to 1960° F. (1071° C.). The second-stage turbine receives the air after it flows past the first stage turbine blades. The air is substantially cooler when it reaches the second-stage turbine.

As the first and second-stage wheels are subjected to different operating temperatures, they are manufactured to have different structural and metallurgical properties. Many conventional first-stage turbines include an inner disk and individually cast blades that have machined fir tree or dovetail attachments that enable blade insertion into mating machined slots in the rim of the disk. The inserted blade design enables each of the blades to be coated with materials that can be applied using an overlay process and that are typically more resistant to a hot and corrosive environment than a diffusion bond coating, and to perform the coating methods before assembling the blades on the disk. The inserted blade design also enables the use of a disk material that is different from that of the blades to provide long term durability and low cycle fatigue (LCF) life for the first-stage turbine.

First-stage turbines having the inserted blade design may experience axial blade shift or blade walk during engine operation. Although it is desirable to eliminate the potential for axial shift or walk, to date there has not been a suitable alternative to the inserted blade design that bestows suitable metallurgical properties for the disk and blades. Also, the high operational temperatures and attachment stresses that are subjected on the turbines require machining the individual blades and slots to tight tolerances. This involves excessive labor and time. Accordingly, it is desirable to provide a first-stage APU turbine that is not susceptible to axial blade shift or blade walk, but that is also capable of operating at very high temperatures and in a highly corrosive environment. In addition, it is desirable to provide a first-stage APU turbine that includes a disk and blades with different metallurgical properties. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

According to one embodiment of the invention, a gas turbine engine is provided that includes an air inlet, a compressor that receives and compresses air from the air inlet, a combustion chamber that receives compressed air from the compressor and combusts fuel to produce high energy air, and a first-stage turbine receiving the high energy air directly from the combustion chamber. The first-stage turbine includes a disk formed from a first alloy, and a unitary blade ring formed from a second alloy that is different than the first alloy. The unitary blade ring includes an annular member joined to the disk, and blades that are integrally formed with the annular member.

According to another embodiment of the invention, a first-stage turbine is provided that is adapted for receiving high energy air directly from a combustion chamber in a gas turbine engine auxiliary power unit. The first-stage turbine includes a disk formed from a first alloy and having an outer surface, and a unitary blade ring formed from a second alloy that is different than the first alloy. The unitary blade ring includes an annular member having an inner surface that is joined to the disk, and blades that are integrally formed with the annular member.

According to yet another embodiment of the invention, a method is provided for manufacturing a first-stage turbine adapted for receiving high energy air directly from a combustion chamber in a gas turbine engine. A powdered first alloy is hot isostatic pressed to form a disk having an outer surface. A unitary blade ring having an inner surface is also cast from a second alloy that is different than the first alloy. The unitary blade ring includes an annular member, and blades that are integrally formed with the annular member. The disk and the unitary blade ring are joined together, and the joined disk and ring are solution heat treated.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
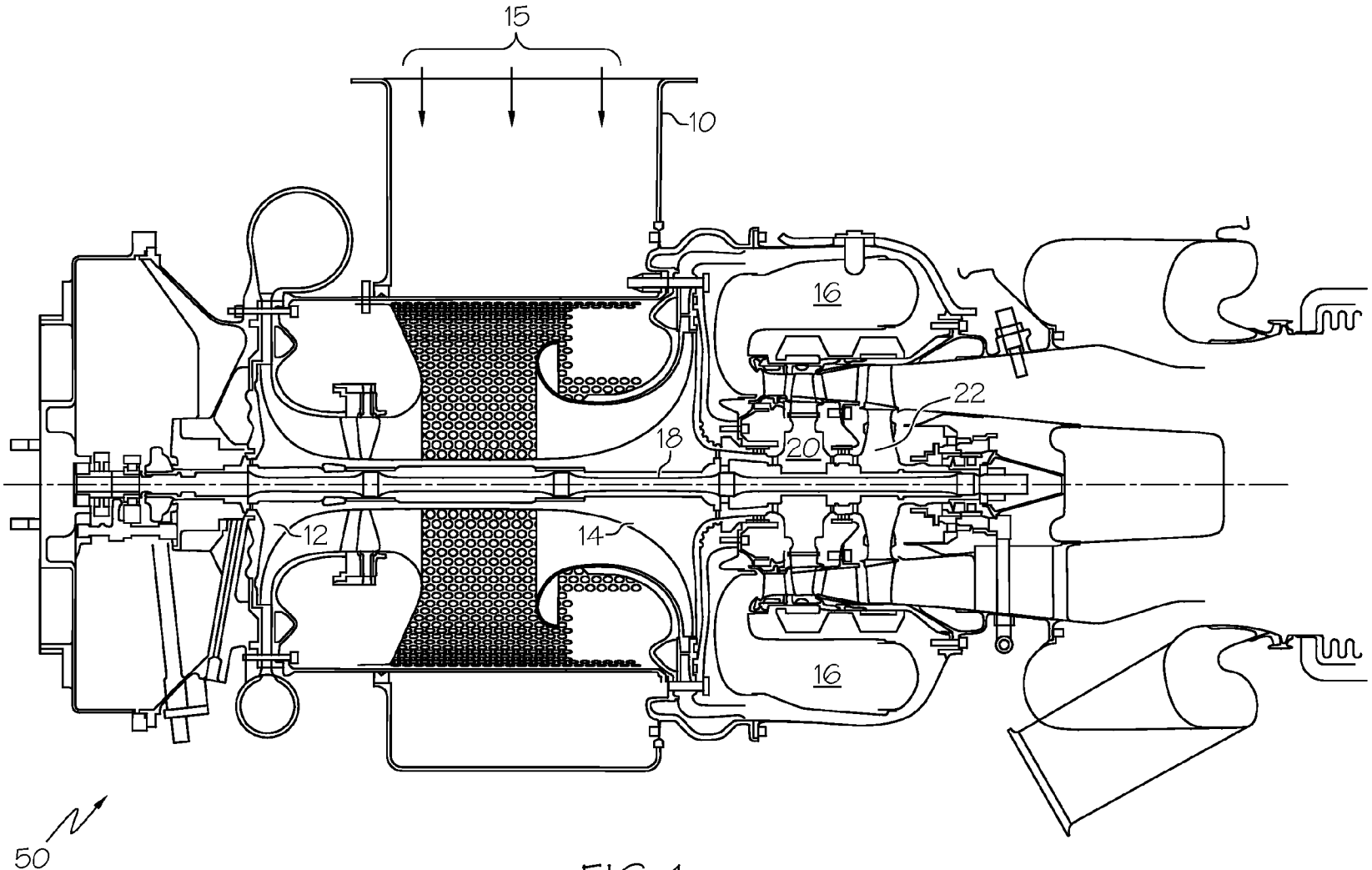
FIG. 1 is a cross-sectional view of an aircraft APU having a two-stage power turbine assembly according to an embodiment of the invention.

FIG. 1 is a cross-sectional view of an aircraft APU 50 having a two-stage power turbine assembly according to an embodiment of the invention. During operation of the APU 50, an inlet 10 receives ambient airflow 15, which is then directed to either a load compressor 12 or an engine compressor 14. Both compressors 12 and 14 are rotatably mounted on a shaft 18. The load compressor 12 draws in and compresses air for use as part of an environment control system (ECS) to cool and heat the aircraft interior. The engine compressor 14 draws in and compresses air that will be used to provide auxiliary power. An annular combustor 16 receives fuel from a fuel source and the compressed air from the engine compressor 14. Fuel combustion produces high energy compressed air that is provided to a two-stage power turbine assembly. The high energy air flows along airfoils on a first-stage turbine 20, causing it to rotate. After passing the first-stage turbine 20, the air flows to airfoils on a second-stage turbine 22. The first and second-stage turbines 20 and 22 are both mounted on the shaft 18. Rotation of the two-stage power turbine assembly generates work to drive the compressors 12 and 14, and to power other aircraft components.

From the points at which the high energy compressed air reaches the first and second-stage turbines 20 and 22, the air temperature cools between about 400 and about 600° F. For example, the first-stage turbine 20 may be receiving air at a temperature of about 1960° F. (1071° C.) or higher, and the second stage turbine 22 may be receiving air at a temperature of about 1500° F. (816° C.). Although a dual-stage turbine assembly is incorporated into the APU 50 depicted in FIG. 1, the first-stage turbine 20 may be included in different multi-stage turbine assemblies that include three or more turbines in series. As will be subsequently described in detail, the architecture and materials for the first-stage turbine 20 enables its continued operational exposure to very high energy air flowing directly from the combustor 16.

Figure 3:
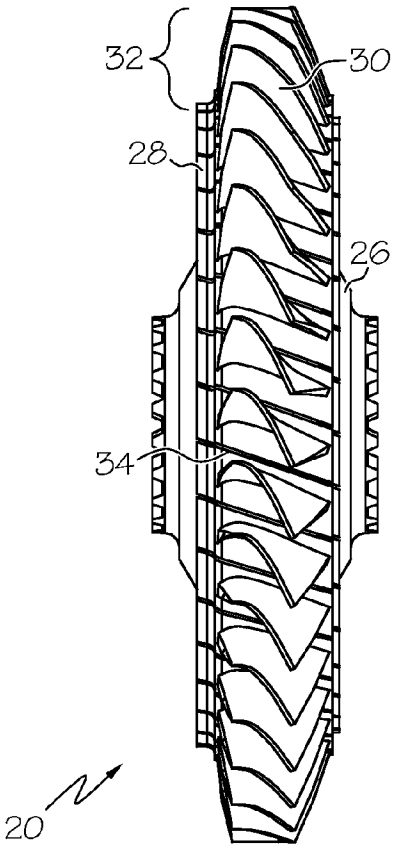
FIG. 3 is a side view of the first-stage power turbine depicted in FIG. 2.
Figure 2:
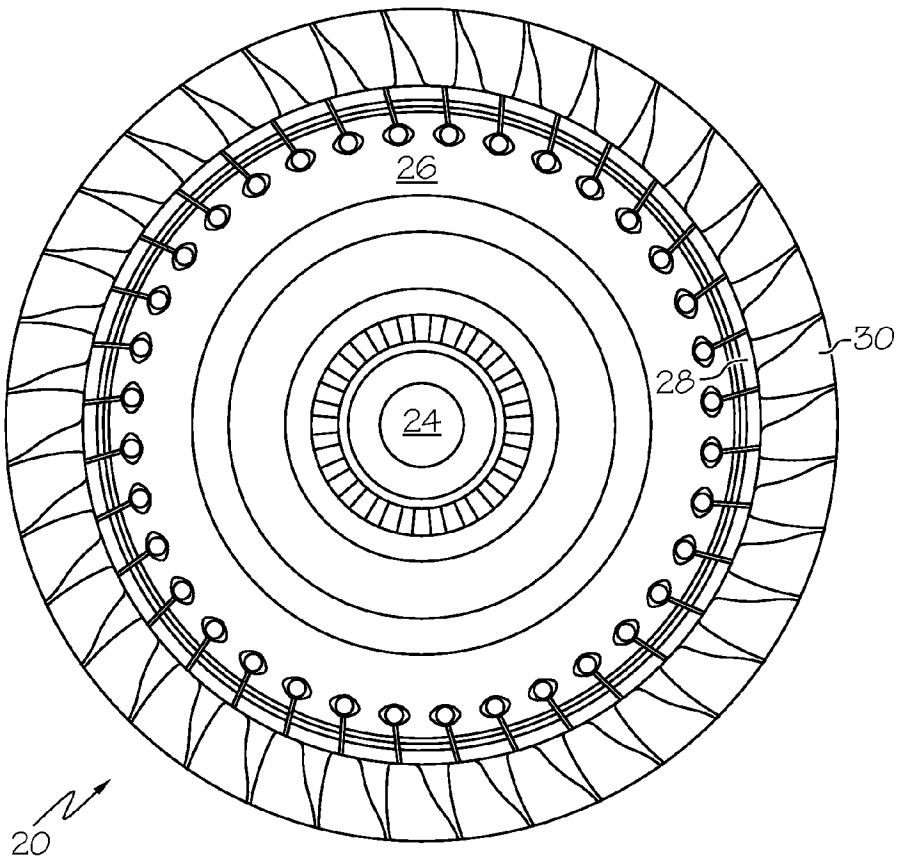
FIG. 2 is a front view of a first-stage power turbine that is included in an aircraft APU according to an embodiment of the invention.
Figure 5:
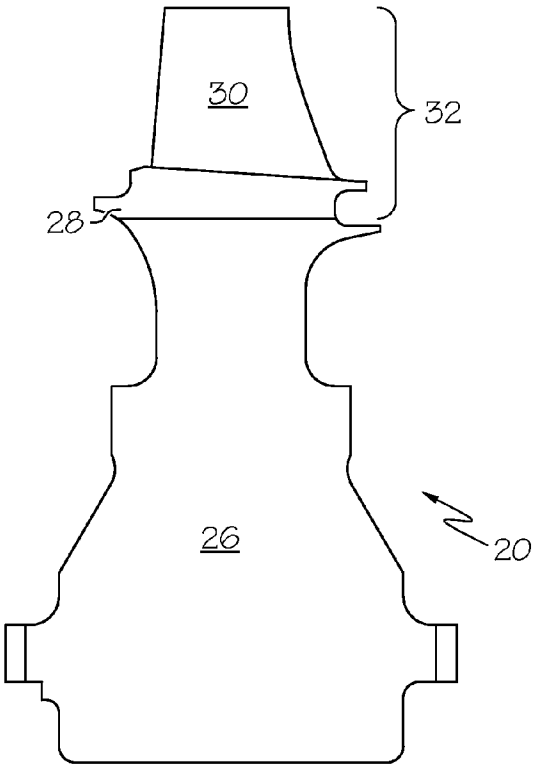
FIG. 5 is a cross-sectional view along a radius of the first-stage power turbine depicted in FIGS. 2 to 4.
Figure 4:
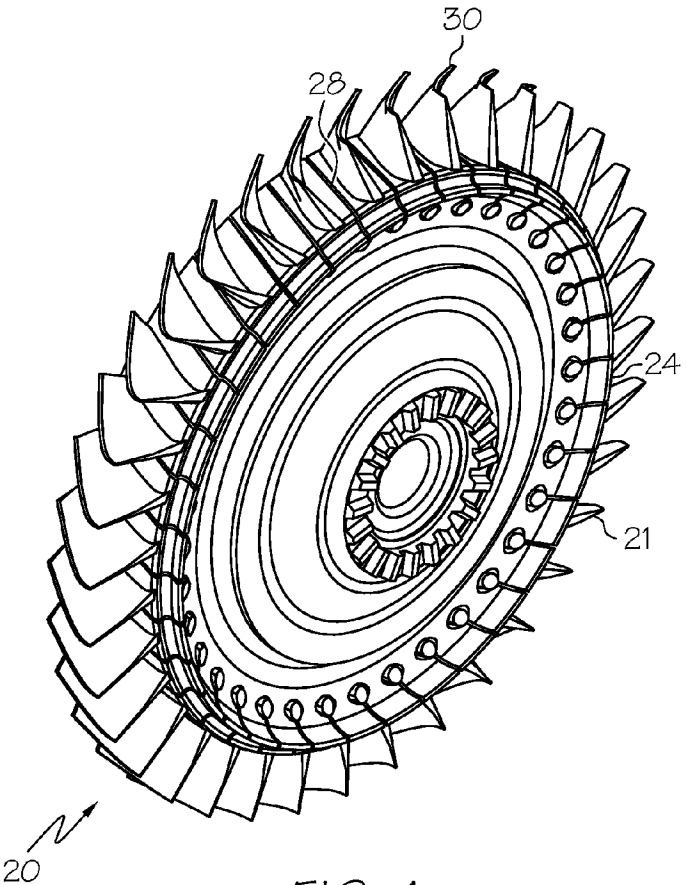
FIG. 4 is a perspective view of the first-stage power turbine depicted in FIGS. 2 to 3.

FIGS. 2 to 4 provide different views of an exemplary first-stage turbine 20. The turbine 20 includes a disk 26 having a centrally-formed bore 24, and blades 30 that are components of a unitary blade ring 32. Unlike conventional first-stage turbines having an inserted blade design, the turbine 20 is a unitary dual alloy structure, with the blade ring 32 being formed as an annular construct from a first material, and the disk being formed from a second material. Formed integrally with the blades 30 as part of the blade ring 32 is an annular member 28 that functions as a support base for each of the blades 30, and also has an inner diameter that is metallurgically bonded to the disk 26. FIG. 5 is a cross-sectional view along a radius of the first-stage turbine 20. The blade ring 32, which is made from the first material, includes the annular member 28 and each of the blades 30. According to an exemplary embodiment, the blade ring 32 includes a chemically homogenous body formed from a single material, and the disk 26 includes a chemically homogenous body formed from a different single material. As will be further described, the disk 26 and/or the blade ring 32 may also include one or more thermal barrier, environmental barrier and/or oxidation barrier coatings.

To provide a first-stage dual alloy turbine, the disk and blade ring materials are carefully selected based on characteristics such as heat and corrosion resistance, and thermal expansion compatibilities. Such precision is not necessary using conventional first-stage turbines that incorporate the inserted blade design because the design is suitable for the high temperatures and the corrosive environment created by the high energy air flowing directly from a combustor. By incorporating the inserted blade design, blades could be made from durable but expensive alloys, and also individually coated with protective barrier materials that are not needed on the turbine disk. However, first-stage turbines having the inserted blade design may experience axial blade shift or blade walk during engine operation. Also, the high operational temperatures and attachment stresses that are subjected on the turbines require machining the individual blades and slots to tight tolerances. This involves excessive labor and time. Although it is desirable to eliminate these inconveniences, there has not previously been a suitable alternative to the inserted blade design that bestows suitable metallurgical properties for the disk and blades.

According to an exemplary embodiment, the first-stage dual alloy turbine disk 26 is made from an alloy having high LCF resistance properties, and the blade ring 32 is made from a highly corrosive resistant alloy. According to a preferred embodiment, the disk 26 is formed from an alloy selected from the class of alloys known as powdered metal (PM) Astroloy, and the blade ring 32 is formed from an alloy manufactured and sold under the mark C101. The following Table 1 provides elemental weight percent ranges for the C101 alloy, and Table 2 provides elemental weight percent ranges for the PM Astroloy alloy.

TABLE 1

| Element | Min. | Max. |
|---|---|---|
| Carbon | 0.07 | 0.20 |
| Manganese | — | 0.10 |
| Silicon | — | 0.10 |
| Phosphorus | — | 0.015 |
| Sulfur | — | 0.015 |
| Chromium | 12.20 | 13.00 |
| Cobalt | 8.50 | 9.50 |
| Molybdenum | 1.70 | 2.10 |
| Tungsten | 3.85 | 4.50 |
| Tantalum | 3.85 | 4.50 |
| Titanium | 3.85 | 4.15 |
| Aluminum | 3.20 | 3.60 |
| Al + Ti | 7.30 | 7.70 |
| Hafnium | 0.75 | 1.05 |
| Boron | 0.010 | 0.020 |
| Zirconium | 0.03 | 0.14 |
| Iron | — | 0.50 |
| Columbium | — | 0.10 |
| Nickel | | Remainder |

TABLE 2

| Element | Minimum | Maximum |
|---|---|---|
| Carbon | 0.02 | 0.04 |
| Manganese | — | 0.15 |
| Silicon | — | 0.20 |
| Phosphorous | — | 0.015 |
| Sulfur | — | 0.015 |
| Chromium | 14.00 | 16.00 |
| Cobalt | 16.00 | 18.00 |
| Molybdenum | 4.50 | 5.50 |
| Titanium | 3.35 | 3.65 |
| Aluminum | 3.85 | 4.15 |
| Boron | 0.015 | 0.025 |
| Zirconium | — | 0.06 |
| Tungsten | — | 0.05 |
| Iron | — | 0.50 |
| Copper | — | 0.10 |
| Lead | — | 0.0010 (10 ppm) |
| Bismuth | — | 0.00005 (0.5 ppm) |
| Oxygen | — | 0.016 (160 ppm) ① |

TABLE 2-continued

| Element | Minimum | Maximum |
|---|---|---|
| Nitrogen | — | 0.0220 (220 ppm) ② 0.0050 (50 ppm) |
| Nickel | | Remainder |

① Maximum allowable oxygen content for −140/−150 mesh (−106 μm) powder.
② Maximum allowable oxygen content for −270 mesh (−53 μm) powder.

According to another exemplary embodiment, the oxygen content for the PM Astroloy is as high as 0.0250 percent by weight. Furthermore, the nitrogen content is as high as 0.0060 percent by weight according to another exemplary embodiment. For such alloys, all other elements are present according to the ranges laid out in Table 1.

Figure 6:
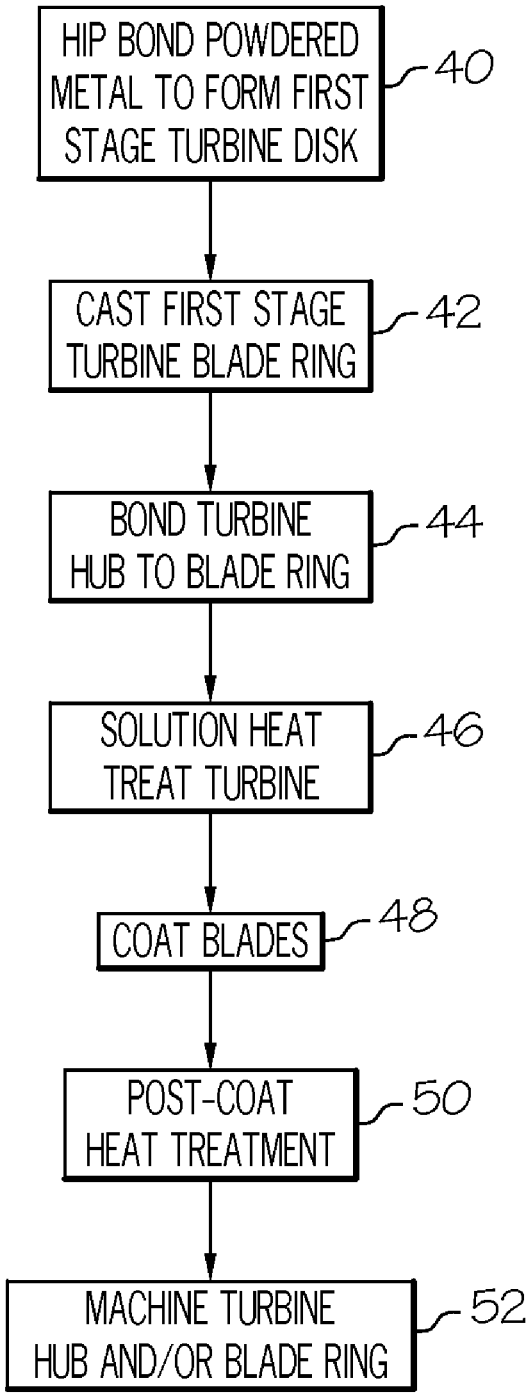
FIG. 6 is a flow diagram that outlines an exemplary method of manufacturing a first-stage turbine according to an embodiment of the present invention.

Turning now to FIG. 6, a flow diagram is illustrated that outlines an exemplary method of manufacturing the first-stage turbine of the present invention. As step 40, the first stage turbine disk 26 is manufactured. The blade ring 32 is manufactured as step 42 as a unitary member that includes both the annular member 28 and the blades 30. The annular member 28 has an inner surface, the diameter of which is sized to match with the diameter of an outer surface of the disk. Although various conventional manufacturing processes may be employed, the disk 26 is preferably formed by performing a hot isostatic pressing (HIP) process in which a powdered metal is pressed and thereby bonded in the shape of the disk 26. Furthermore, the blade ring 32 is preferably formed by a casting process. Additional machining and processing will be performed in subsequent method steps to bring the disk 26 and the blade ring 32 to their final dimensions.

The disk and blade ring are metallurgically bonded as step 44 using a suitable joining process. An exemplary bonding procedure is performed by hot isostatic pressing the disk outer surface to the blade ring inner surface. The HIP parameters are tailored to provide a strong and durable bond, and may be varied to suit the disk and blade ring materials.

After metallurgically bonding the disk 26 and the blade ring 32, a solution heat treatment cycle is performed. The heat treatment cycle brings the material to solution and improves the material's grain structure. As one example, a swirly gamma prime grain formation that may negatively impact the material life is commonly formed as a product of casting the disk and/or blade ring. The swirly gamma prime grain formation can be substantially eliminated by a highly controlled heat treatment, followed by a controlled cooling operation.

According to an exemplary embodiment in which the disk is formed from PM Astroloy and the blade ring is formed from C101, a solution heat treatment cycle is performed by heating the joined disk and blade ring to a temperature ranging between about 2175 and about 2225° F. (between about 1191 and 1218° C.). The joined disk and blade ring is heated in an inert atmosphere or under vacuum, and is held for approximately two hours at the raised temperature. The temperature is then lowered at a controlled rate of between about 100 and 200° F. per minute (between about 38 and about 93° C. per minute) in an inert atmosphere or under vacuum pressure until it reaches about 1800° F. (about 982° C.). The joined disk and blade ring is then rapidly air cooled or gas fan cooled until it reaches room temperature.

After bonding and heat treating the disk 26 and the blade ring 32, the blades 30 are diffusion coated with an oxidation barrier material as step 48. A suitable barrier material for many alloys, including C101, is platinum aluminide. Exemplary coating processes include line-of-sight deposition processes such as chemical vapor deposition that allow for the barrier material to be selectively deposited onto the blades 30 while avoiding the disk 26 and much or all of the annular member 28. The coating preferably has a thickness ranging between 0.0015 and 0.0025 inch (between about 38.1 and about 63.5 microns) when, for example, the blades are formed from C101, although the coating thickness may be tailored to accommodate other blade alloys.

As step 50, a post-coating heat treatment cycle is performed. The heat treatment cycle brings at least the blade material to solution, and allows the oxidation barrier material to diffuse partially into the blade alloy. The heat treatment cycle also serves to age and solution the disk alloy. The heat treatment parameters are tailored to provide a strong and durable bond, and may be varied to suit the disk and blade ring materials.

Finally, any necessary machining is performed on the disk 26 and/or the blade ring 32 in order to bring the first stage turbine 20 to its final dimensions. For example, returning to FIG. 3, slots 34 are machined into the annular member 28 between each of the blades 30 to provide slight gaps that allow for thermal expansion of the annular member material.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of manufacturing a first-stage turbine adapted for receiving high energy air directly from a combustion chamber in a gas turbine engine, the method comprising the steps of:

hot isostatic pressing a first alloy comprising about 0.02 to about 0.04 wt % carbon, 0 to about 0.15 wt % manganese, 0 to about 0.20 wt % silicon, 0 to about 0.015 wt % phosphorous, 0 to about 0.015 wt % sulfur, 0 to about 0.06 wt % zirconium, 0 to about 0.05 wt % tungsten, 0 to about 0.50 wt % iron, 0 to about 0.10 wt % copper, 0 to about 0.0010 wt % lead, 0 to about 0.00005 wt % bismuth, 0 to about 0.0250 wt % oxygen, 0 to about 0.0060 wt % nitrogen, about 14 to about 16 wt % chromium, about 16 to about 18 wt % cobalt, about 4.5 to about 5.5 wt % molybdenum, about 3.35 to about 3.65 wt % titanium, about 3.85 to about 4.15 wt % aluminum, and about 0.015 to about 0.025 wt % boron, and the balance nickel in the form of a powder, with the maximum allowable oxygen content depending on the size of the powder, to form a disk having an outer surface;

casting a unitary blade ring having an inner surface from a second alloy comprising about 0.07 to about 0.20 wt % carbon, 0 to about 0.10 wt % manganese, 0 to about 0.10 wt % silicon, 0 to about 0.015 wt % phosphorus, 0 to about 0.015 wt % sulfur, about 12.20 to about 13 wt % chromium, about 8.5 to about 9.5 wt % cobalt, about 1.7 to about 2.10 wt % molybdenum, about 3.85 to about 4.5 wt % tungsten, about 3.85 to about 4.50 wt % tantalum, about 3.85% to about 4.15 wt % titanium, about 3.2 to about 3.60 wt % aluminum, about 7.30 to about 7.70 wt % aluminum and titanium combined, about 0.75 to about 1.05 wt % hafnium, about 0.010 to about 0.020 wt % boron, about 0.03 to about 0.14 wt % zirconium, 0 to about 0.50 wt % iron, 0 to about 0.10 wt % columbium, and the balance nickel, the unitary blade ring comprising an annular member, and blades that are integrally formed with the annular member;

joining the disk and the unitary blade ring; and solution heat treating the joined disk and unitary blade ring.

2. The method according to claim 1, further comprising the steps of:

coating the blades with an oxidation barrier material after solution heat treating the joined disk and unitary blade ring; and performing a heat treatment cycle at a temperature sufficient to diffuse the oxidation barrier material partially into the blades.

3. The method according to claim 2, further comprising the step of:

machining the joined disk and unitary blade ring to a final shape after performing the heat treatment cycle.

4. The method according to claim 3, wherein the step of machining the joined disk and unitary blade ring comprises machining gaps into the annular member between the blades.

5. The method according to claim 1, wherein the step of joining the disk and the unitary blade ring comprises hot isostatic pressing the disk outer surface to the blade ring inner surface.

6. The method according to claim 1, wherein the step of solution heat treating the joined disk and unitary blade ring comprises heating the joined disk and unitary blade ring to a first temperature ranging between about 2175 and about 2225° F. in an inert atmosphere or under vacuum pressure.

7. The method according to claim 6, wherein the step of solution heat treating the joined disk and unitary blade ring further comprises:

maintaining the first temperature for about two hours;

cooling the joined disk and unitary blade ring at a controlled rate of between about 100 and 200° F. per minute in an inert atmosphere or under vacuum to a second temperature of about 1800° F.; and further cooling the joined disk and unitary blade ring after cooling to the second temperature.

8. A method of manufacturing a first-stage turbine adapted for receiving high energy air directly from a combustion chamber in a gas turbine engine, the method comprising the steps of:

hot isostatic pressing a first alloy in the form of a powder to form a disk having an outer surface;

casting a unitary blade ring having an inner surface from a second alloy that is different than the first alloy, the unitary blade ring comprising an annular member, and blades that are integrally formed with the annular member;

joining the disk and the unitary blade ring; and solution heat treating the joined disk and unitary blade ring, wherein the step of solution heat treating the joined disk and unitary blade ring comprises heating the joined disk and unitary blade ring to a first temperature ranging between about 2175 and about 2225° F. in an inert atmosphere or under vacuum pressure.

9. The method according to claim 8, further comprising the steps of:

coating the blades with an oxidation barrier material after solution heat treating the joined disk and unitary blade ring; and performing a heat treatment cycle at a temperature sufficient to diffuse the oxidation barrier material partially into the blades.

10. The method according to claim 9, further comprising the step of:

machining the joined disk and unitary blade ring to a final shape after performing the heat treatment cycle.

11. The method according to claim 10, wherein the step of machining the joined disk and unitary blade ring comprises machining gaps into the annular member between the blades.

12. The method according to claim 8, wherein the first alloy that is HIP bonded to form the disk comprises about 0.02 to about 0.04 wt % carbon, 0 to about 0.15 wt % manganese, 0 to about 0.20 wt % silicon, 0 to about 0.015 wt % phosphorous, 0 to about 0.015 wt % sulfur, 0 to about 0.06 wt % zirconium, 0 to about 0.05 wt % tungsten, 0 to about 0.50 wt % iron, 0 to about 0.10 wt % copper, 0 to about 0.0010 wt % lead, 0 to about 0.00005 wt % bismuth, 0 to about 0.0250 wt % oxygen, 0 to about 0.0060 wt % nitrogen, about 14 to about 16 wt % chromium, about 16 to about 18 wt % cobalt, about 4.5 to about 5.5 wt % molybdenum, about 3.35 to about 3.65 wt % titanium, about 3.85 to about 4.15 wt % aluminum, and about 0.015 to about 0.025 wt % boron, and the balance nickel in the form of a powder, with the maximum allowable oxygen content depending on the size of the powder.

13. The method according to claim 8, wherein the second alloy that is cast to form the unitary blade ring comprises about 0.07 to about 0.20 wt % carbon, 0 to about 0.10 wt % manganese, 0 to about 0.10 wt % silicon, 0 to about 0.015 wt % phosphorus, 0 to about 0.015 wt % sulfur, about 12.20 to about 13 wt % chromium, about 8.5 to about 9.5 wt % cobalt, about 1.7 to about 2.10 wt % molybdenum, about 3.85 to about 4.5 wt % tungsten, about 3.85 to about 4.50 wt % tantalum, about 3.85% to about 4.15 wt % titanium, about 3.2 to about 3.60 wt % aluminum, about 7.30 to about 7.70 wt % aluminum and titanium combined, about 0.75 to about 1.05 wt % hafnium, about 0.010 to about 0.020 wt % boron, about 0.03 to about 0.14 wt % zirconium, 0 to about 0.50 wt % iron, 0 to about 0.10 wt % columbium, and the balance nickel.

14. The method according to claim 8, wherein the step of joining the disk and the unitary blade ring comprises hot isostatic pressing the disk outer surface to the blade ring inner surface.

15. The method according to claim 8, wherein the step of solution heat treating the joined disk and unitary blade ring further comprises:

maintaining the first temperature for about two hours;

cooling the joined disk and unitary blade ring at a controlled rate of between about 100 and 200° F. per minute in an inert atmosphere or under vacuum to a second temperature of about 1800° F.; and further cooling the joined disk and unitary blade ring after cooling to the second temperature.

* * * * *